United States Patent [19]

Fitzpatrick et al.

[11] 4,365,797

[45] Dec. 28, 1982

[54] SPEED COMPENSATED TIMING CIRCUIT FOR ACTUATING A SHEETER MACHINE

[75] Inventors: Donald C. Fitzpatrick, Chatham, N.Y.; Peter A. Gerard; John F. Davison, both of Dalton, Mass.

[73] Assignee: Beloit Corporation, Beloit, Wis.

[21] Appl. No.: 119,353

[22] Filed: Feb. 7, 1980

[51] Int. Cl.[3] ..... B65H 29/58

[52] U.S. Cl. ..... 271/303; 83/79; 83/106; 414/901

[58] Field of Search ..... 271/303, 305; 93/93 C; 83/106, 79; 414/901, 53, 51; 235/92 SB

[56] References Cited

U.S. PATENT DOCUMENTS

| | | | |
|---|---|---|---|
| 3,027,817 | 4/1962 | Loeffler | 93/93 C |
| 3,543,929 | 12/1970 | Mattia et al. | 83/79 X |
| 3,550,493 | 12/1970 | Benbenek et al. | 83/106 X |
| 3,611,887 | 10/1971 | Shibanumn et al. | 93/93 C |
| 3,870,868 | 3/1975 | Jones | 235/92 SB |
| 4,004,694 | 1/1977 | Sjogren | 271/303 X |

*Primary Examiner*—Bruce H. Stoner, Jr.

*Attorney, Agent, or Firm*—Hill, Van Santen, Steadman, Chiara & Simpson

[57] ABSTRACT

A speed compensated timing circuit which detects the velocity of a moving sheet which is to be cut or otherwise processed and which automatically calculates the time delay for actuating a mechanically operating device which controls the cut sheets and which correctly considers and compensates for the delay time of the actuator.

2 Claims, 22 Drawing Figures

SPEED COMPENSATED TIMING CIRCUIT FOR ACTUATING A SHEETER MACHINE

BACKGROUND OF THE INVENTION

1. Field of the Invention

This invention relates in general to automatic machines which have a fixed delay time and in particular to a speed compensated timing circuit for a machine.

2. Description of the Prior Art

In a process line such as a sheeter operation, there often exists functions which have a fixed delay time between the time of actuation of a device and the reception of the control signal. If the process line always runs at a fixed speed and if the delay is known, it is very simple to anticipate the delay in the actuated device by actuating the system early enough to compensate for the known fixed delay time.

An example of this type of delay would be, for example, the combined times to sense a moving sheet and then energize a solenoid valve, pressurize an air cylinder, and the time for the cylinder to move a piston a known distance to overcome the system's inertia.

However, if the system is to operate at different speeds, the actuation of the system must occur earlier with respect to the web position as, for example, in a sheeter machine at higher web speeds than at lower web speeds.

SUMMARY OF THE INVENTION

The present invention incorporates a sensing means for sensing the velocity of a moving web which is to be cut to form sheets and also detects the instance that spaces between sheets pass a certain point and using these two signals plus the known distance from the device to be actuated from the detector of the spaces between the sheets there is calculated the actuating signal at a time such that the delays in the actuator system are compensated.

Thus, since the distance from the gap position sensor to the position of the actuated device is known, the system will determine how long to wait before signalling the actuator system to begin actuation. At relatively slow speeds, the actuator must wait a considerable time because the sheets must proceed a distance D and the actuator delay time compared to that travel time is small or insignificant. However, when the web is travelling at high speed, the time for the sheet to travel the distance D and the delay time in the actuator may almost equal each other and, thus, the actuating signal may have to be applied almost instantaneously.

Other objects, features and advantages of the invention will be readily apparent from the following description of certain preferred embodiments thereof, taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
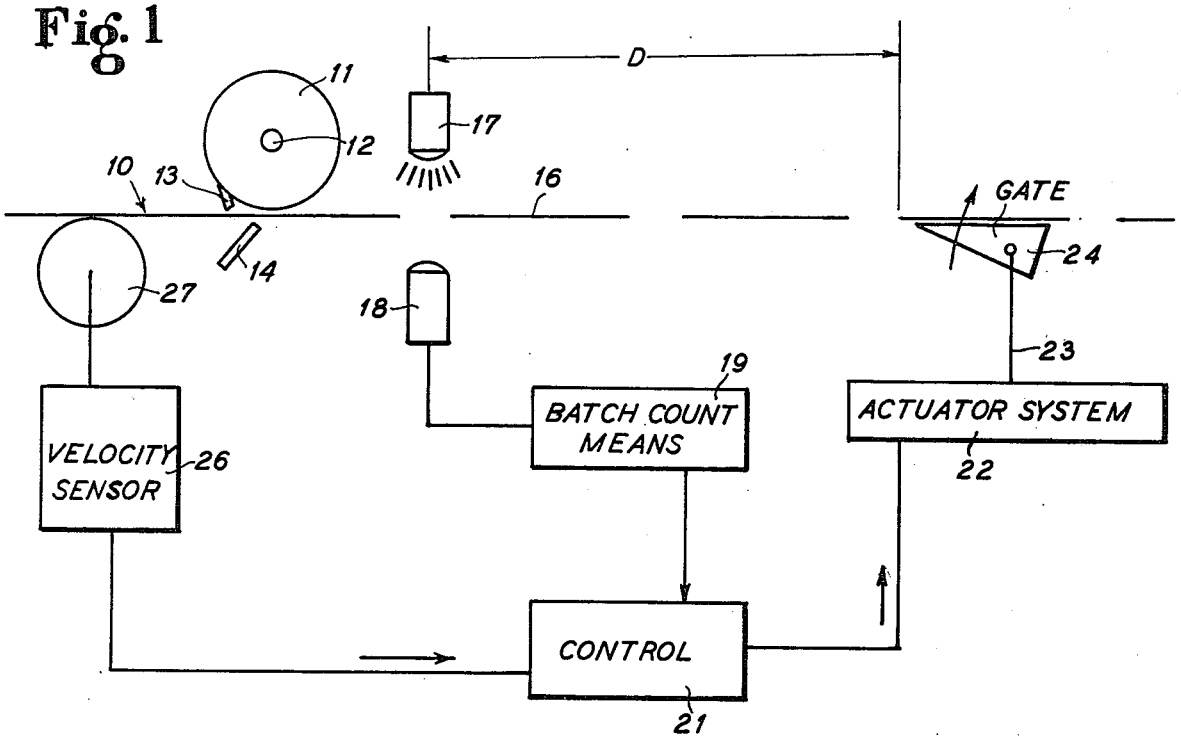
FIG. 1 is a block diagram of the invention.

FIG. 1 illustrates a sheeter for cutting a web 10 into sheets 16 utilizing a knife 13 mounted on a rotary drum 11 supported by a shaft 12 such that when the blade 13 passes a blade 14 on the opposite side of the web the sheets 16 are cut. A velocity sensor 26 is connected to a wheel 27 which is rotated at the speed of the web 10 and the velocity sensor produces a velocity signal which is supplied to a control 21. A light 17 is mounted on one side of the sheet 16 and a light sensor 18 is mounted on the other side and receives light energy between the gaps between adjacent sheets which form pulses that are supplied to a batch count means 19 that supplies an input to the control 21. The control 21 supplies an input to the actuator system 22 which controls through a shaft 23 or other means the movable gate 24 so as to deflect the sheets 16 into suitable piles.

The control 21 calculates from the known distance D between the gap sensor 17–18 and the gate device 24 and the signals from the velocity sensor 26 and the batch count means 19 how long a delay should exist before supplying an actuator signal to the actuator system 22. At relatively slow speeds, a considerable time delay must occur because the gap between the sheets adjacent the gap sensors 17 and 18 must travel the distance D before actuating the gate 24 and the delay time of the actuator is relatively small compared to the travel time of the sheet. However, at high speeds, the travel time and the actuating delay time may become almost equal to each other and the actuating signal would have to be produced by the control 21 almost immediately after the gap detector 17–18 detects the spacing between sheets.

Figure 2:
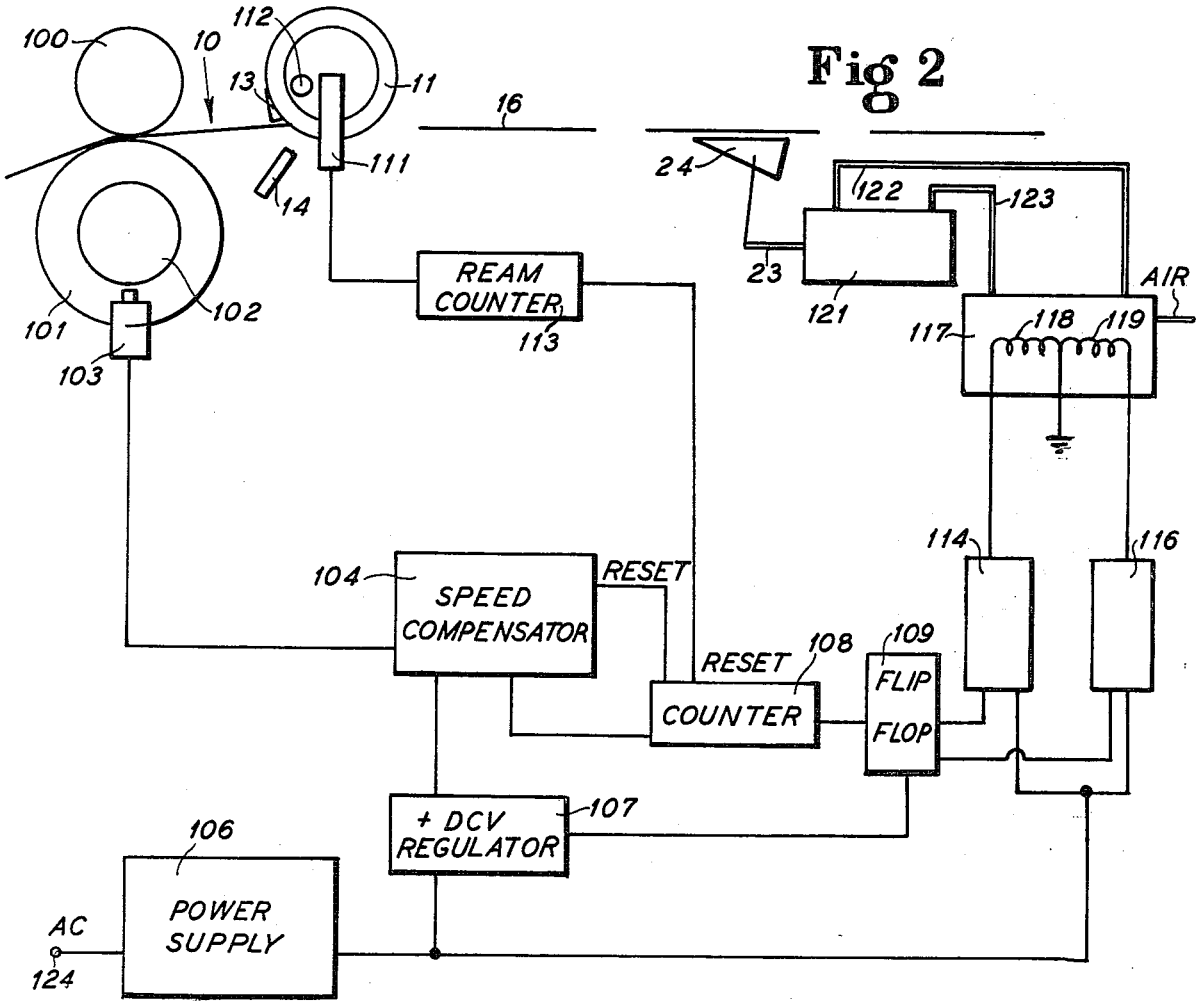
FIG. 2 is a block diagram of a modification of the invention.
Figure 3:
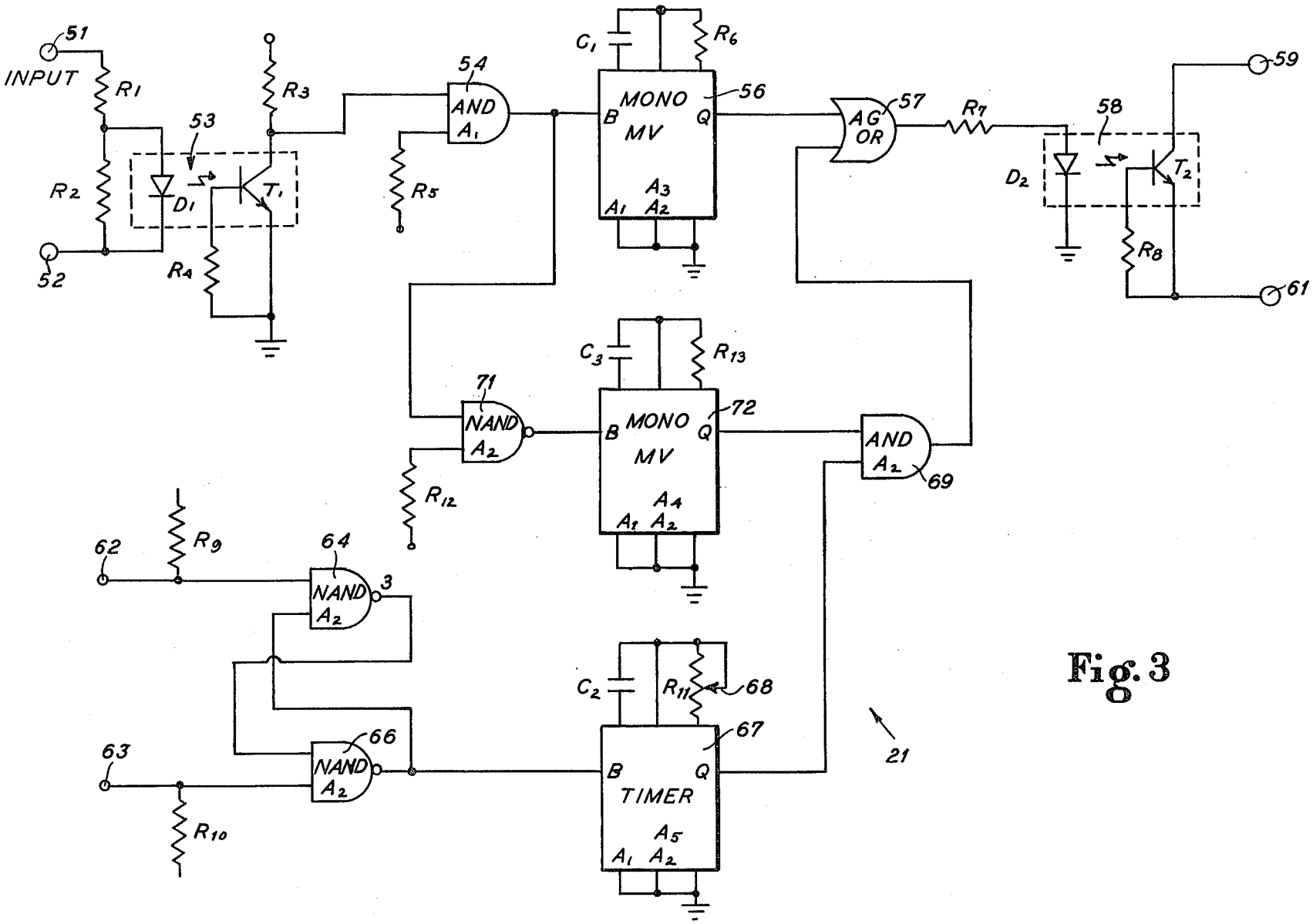
FIG. 3 is an electrical schematic view of the control of the invention.
Figure 4:
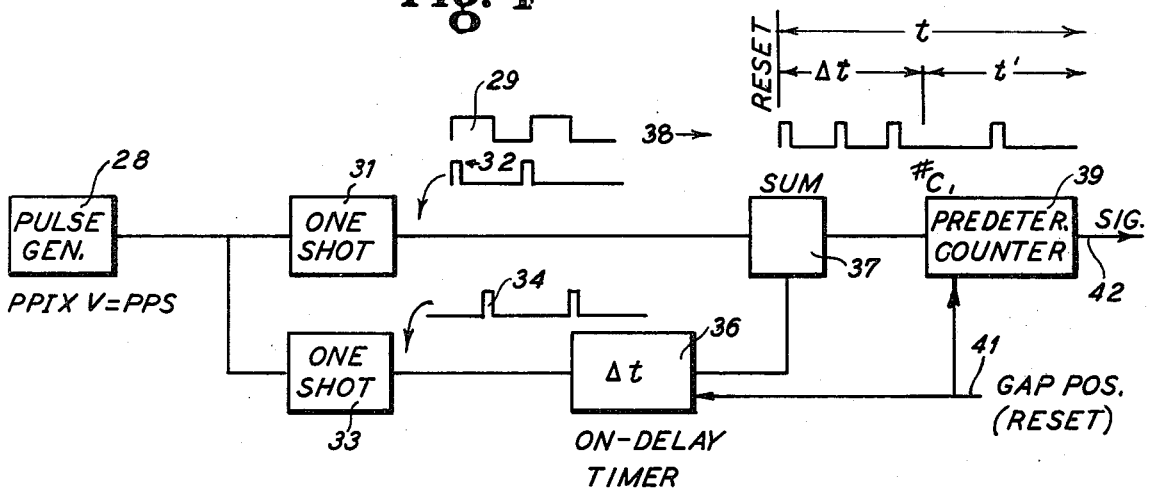
FIG. 4 is a schematic illustrating the invention.

FIG. 4 illustrates the invention wherein a pulse generator 28 uses a rectangular wave form 29 which is supplied to a first one shot generator 31 which produces pulses 32 on the upgoing edges of the wave form 29. A second one shot generator 33 produces upgoing pulses 34 on the downward trailing edges of the wave form 29. An on-delay timer 36 receives the output of the one shot 33 and supplies an input to an adding device 37 which also receives the output of the one shot 31. The output of the adding device 37 comprises the pulse train 38 which is the sum of the pulse trains 32 and 34. A predetermined counter 39 receives the output of the adding device 37 as well as a gap position reset signal which is applied to terminal 41 and which is also applied to the on-delay timer 36. The counter 39 produces an output signal on lead 42 which is the number of pulses during the time "t". The relationship of FIG. 4 to the embodiment of FIG. 1 is that FIG. 4 illustrates the theory and structure for calculating the control signal for actuating the actuator 22. The circuit of FIG. 2 is the actual block diagram of a circuit used and FIG. 3, for example, illustrates an actual embodiment of the control 21 illustrated in FIG. 1. The elements of FIG. 4 would be included in the control 21 of FIG. 1 and illustrates how this element could be constructed. FIG. 3 is a detail view of an actual electrical schematic of the control 21.

Figure 5:
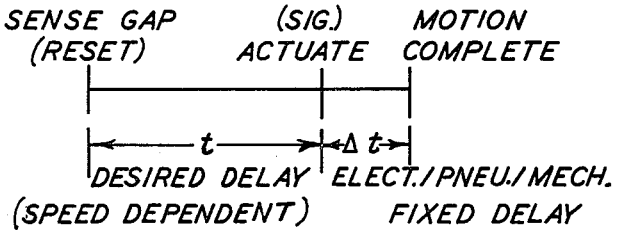
FIG. 5 is a plot illustrating when the various signals must be generated.

FIG. 5 illustrates the time relationship of various actuations and shows the desired delay or wait time which is speed dependent, t, extends from the reset time at which the gap is sensed to the actuate signal point. A fixed inherent delay Δt extends from the signal actuate to the motion complete time and this comprises the electrical pneumatic and mechanical fixed delay times of the actuating system.

$$D = VT = \text{Constant}$$

$$D = V(t + \Delta t)$$

$$t = D/V - \Delta t$$

where $C_1$ equals the predetermined setting of the counter, t equals the delay or wait time, D equals the constant distance between the gap sensor to the actuated device, V is equal to the web speed and Δt is the fixed inherent delay which is equal to the timer setting.

T will be the time required to receive $C_1$ pulses at the counter 39. The counter 39 will receive a pulse train of 2x the output of the pulse generator 28 from the time of reset until the timer times out which is at time of Δt. The pulse train will continue at a 1x rate until $C_1$ is reached and then the actuating signal will then be produced, $$t = \Delta t + t'$$

$$C_0 = 2(PPS \times \Delta t),$$

where $C_0$ equals the number of pulses received by counter 39 during time of Δt $$t' = (C_1 - C_0)/PPS$$

$$t = \Delta t + \frac{C_1 - 2(PPS \times \Delta t)}{PPS} = \frac{C_1}{PPS} - \Delta t$$

$$t = [C_1/(V \times PPI)] - \Delta t,$$

where PPS represents pulses per second, PPI represents pulses per interval

FIG. 3 illustrates the control 21 illustrated in FIG. 1. Photocouples 53 and 58 are utilized to isolate and protect the circuit components between the input and the output. The input signal, (Input) is applied to terminals 51 and 52 and is coupled through the photocoupler 53 comprising the diode D1 and transistor T1 to AND-gate 54 and when a terminal of AND-gate 54 goes positive another terminal will go positive and it in turn is connected to a terminal B of multi-vibrator 56 and to an input of NAND-gate 71. Since 71 is a NAND-gate, when an input is positive no output will occur at a terminal B of multi-vibrator 72 and vice versa. Thus, when the output of gate 71 is positive, a pulse train will exist at terminal B of multi-vibrator 56 and another pulse train which is out of phase with the one which exists at terminal B of multi-vibrator 56 will exist at terminal B of multi-vibrator 72. 56 and 72 are monostable multivibrators and they will each produce a single pulse of fixed duration for each pulse received at their input and thus there will exist two pulse trains one of which occurs at terminal Q of multi-vibrator 56 and the other pulse train will exist at terminal Q of multi-vibrator 72 and these two pulse trains will be out of phase. These pulse trains have a pulse duration sufficient to actuate a counter and will not overlap until the input reaches a very high frequency signal.

Figure 6A:
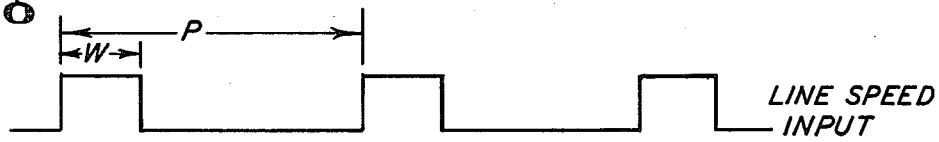
FIGS. 6A and 6B are plots of pulse trains for describing the invention.
Figure 6B:
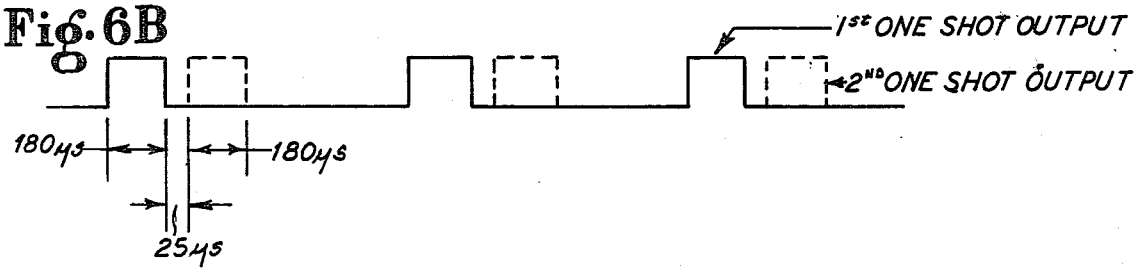

However, if the pulse train is not symmetrical as illustrated in FIGS. 6A and 6B for the timing given in FIGS. 6A and 6B the maximum speed will occur when the pulse width W is equal to 205 μsec. If W is X% of the period P $$P = \frac{205\ \mu s}{X\%} \times 100$$

$$\text{and } f_{max} = \frac{1}{P}$$

$$\text{and } PPI = V_M \times P \times \frac{12}{60}$$

For example if X=25%

$$f_{max} = \frac{.25}{205\ \mu s} = 1.2\ \text{KHz},$$

$$\text{and } \frac{1}{PPI} = 1500 \times \frac{1}{1.2K} \times \frac{1}{5} = .25\ \frac{\text{in.}}{\text{Pulse}}$$

Figure 7:
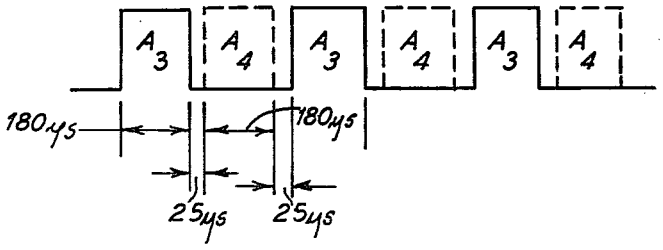
FIG. 7 is a plot of pulse train signals for illustrating the invention.

Also, it is obvious that if the on time is greater than 50%, X% would represent the off time, in other words, the smaller portion of the cycle. Actually, the input pulse train must have a minimum pulse width of 205 μsec. and be symmetrical for optimum speed. The pulse width generated by the one shots 31 and 33 is 180 μsec. Any counter will require a minimum on time and a minimum off time for it to distinguish incoming pulses. The minimum on time for a counter used in a practical embodiment was 175 μsec. and the minimum off time was 25 μsec. For these values the maximum cycle rate would be when the off time becomes less than 25 μsec. as illustrated in FIG. 7. At that point, the frequency of the incoming pulses would be $$f = \frac{1}{2(180 + 25)} \times 10^6 = 2.4\ \text{KHz}.$$

Therefore, if for example, a top speed of 1500 feet per minute is required, the pulse resolution of PPI would be as follows:

$$\frac{1}{PPI} = 1500\ \frac{\text{FT}}{\text{MIN}} \times \frac{1}{2.4K}\ \frac{\text{sec.}}{\text{Pulse}} \times \frac{12\ \text{in}}{\text{FT}} \times \frac{1m}{60\ \text{sec}} = .125\ \frac{\text{IN}}{\text{Pulse}}$$

This is true if the input is symmetrical.

With reference to FIG. 3, the pulse train from multivibrator 72 will pass to OR-gate 57 through the AND-gate 69 only when the terminal of AND-gate 69 is held high. This is the function of the timer 67. Its ON-time starts when the gate is reset and lasts for an adjustable time as set by the potentiometer 68. This time is approximately equal to the fixed delay of the actuator system. The OR-gate 57 combines the two pulse trains from the multi-vibrator 56 and the multi-vibrator 72 and supplies it to the counter through terminals 59 and 61. The preset number in the counter 39 illustrated in FIG. 4 represents the distance from the gap sensor 17–18 to the actuated device 24 and C1=(D/1/PPI). In an actual embodiment according to the invention, the AND-gates 54 and 69 were type 7408. NAND-gates 71, 64 and 66 were type 7400. Circuits 56, 72 and 67 were type 74121. The OR-gate 57 was type 7432. Elements 53 and 58 were GE type 4N37. The resistors had the following values:

R1=330 ohms
R2=1K ohms
R3=5.6K ohms
R4=100K ohms
R5=1K ohms
R6=2.7K ohms
R7=330 ohms
R8=100K ohms
R9=1K ohms
R10=1K ohms
R11=50K ohms
R12=1K ohms
R13=2.7K ohms C1 and $C_3$ had values of 0.1MF. Capacitor $C_2$ had a value of 4.7MF.

A specific application of the invention is illustrated in FIG. 2. The moving web 10 passes between the roller 100 and a roller 101 which carries a magnetic track 102 which is detectable by the magnetic pickup 103 to measure the velocity of the moving web 10 which is fed to the speed compensator 104. The drum 11 carries the cutter knife 13 and a light source 112 which is detected by an electric eye 111 which supplies an output to the ream counter 113. The output of the ream counter and the speed compensator are supplied to the counter 108 wherein the output of the ream counter provides a reset signal. A TTF flip-flop 109 receives the output of the counter 108. A DC regulator 107 supplies inputs to the speed regulator 104 and to the flip-flop 109. A pair of solid state relays 114 and 116 are connected to outputs from the flip-flop 109 and are connected to a DC solenoid 117 which has windings 118 and 119 to control the air input to a pneumatic cylinder 121 through air supply lines 122 and 123, respectively. The output shaft 23 of the cylinder 121 controls the actuator device 24.

A power supply 106 supplies an input to the DC regulator 107 and to the solid state relays 114 and 116.

So as to simplify the system, an equal delay time is assumed for the cylinder and the actuated gate 24 to operate in the opening mode as for the same time as for them to operate in the closing mode. If in an actual system this does not hold, this can be compensated.

By using the teeth on the gears on drum 101 or the draw drum pulley teeth 102 to generate pulses, the maximum speed would be $$\text{Let } X\% = 35$$

$$\frac{1}{PPI} = \frac{20'' \text{ Drum}}{30'' \text{ Gear}} \times .375 \frac{\text{in}}{\text{Tooth}} = .25 \frac{\text{in}}{\text{Pulse}} \text{ (Approx. for Ball gear)}$$

$$f_{MAX} = \frac{.35}{205\ s} = 1.7 \text{ KHz}$$

$$V_{MAX} = .25 \times 1.7 \times 5 - 2125 \frac{\text{FT}}{\text{MIN.}}$$

If we stay 10% under for a margin $$V_{MAX} = (1900'/\text{MIN.})$$

Figure 8A:
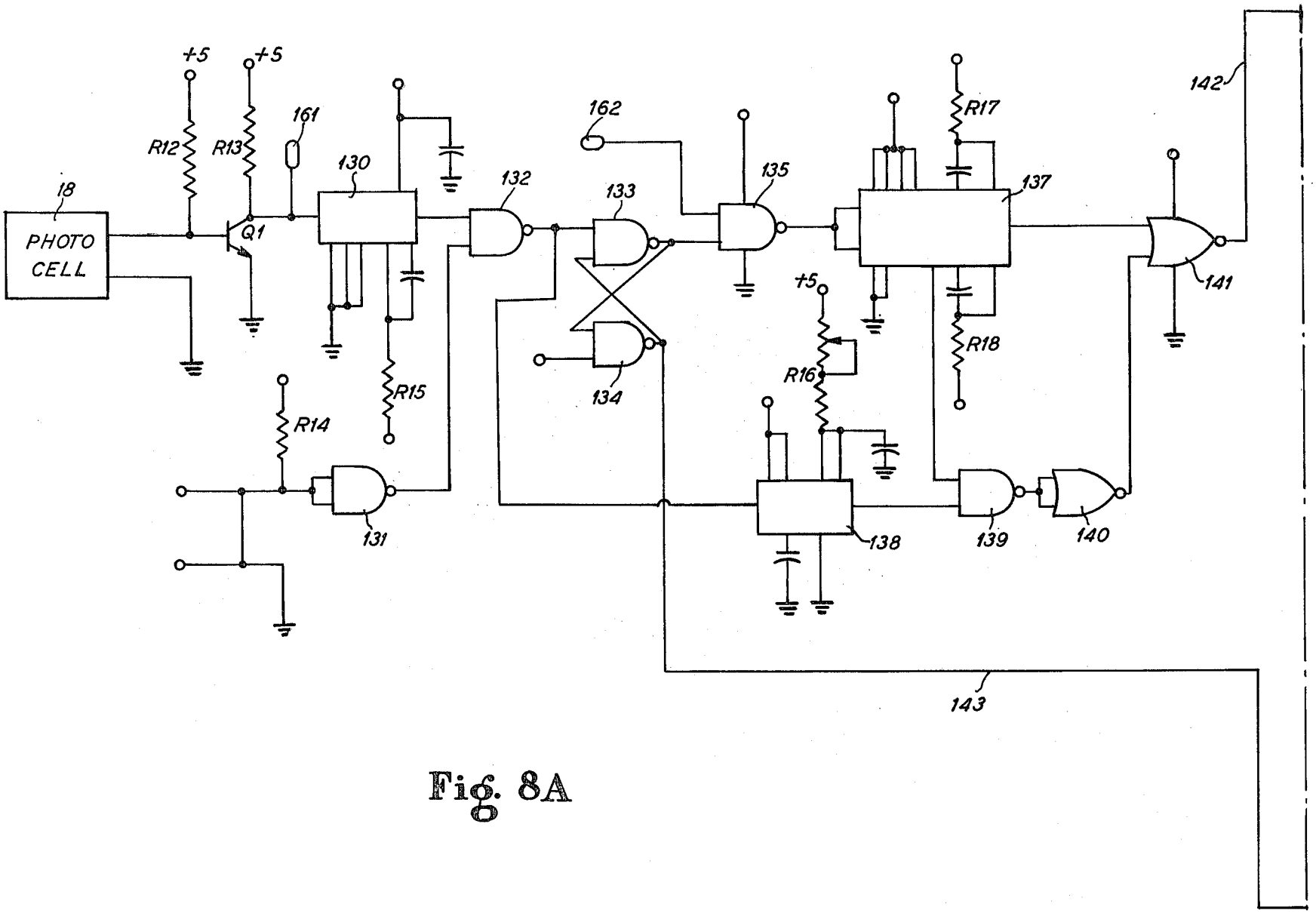
FIGS. 8A and 8B comprise a schematic of a modified form of the invention.
Figure 8B:
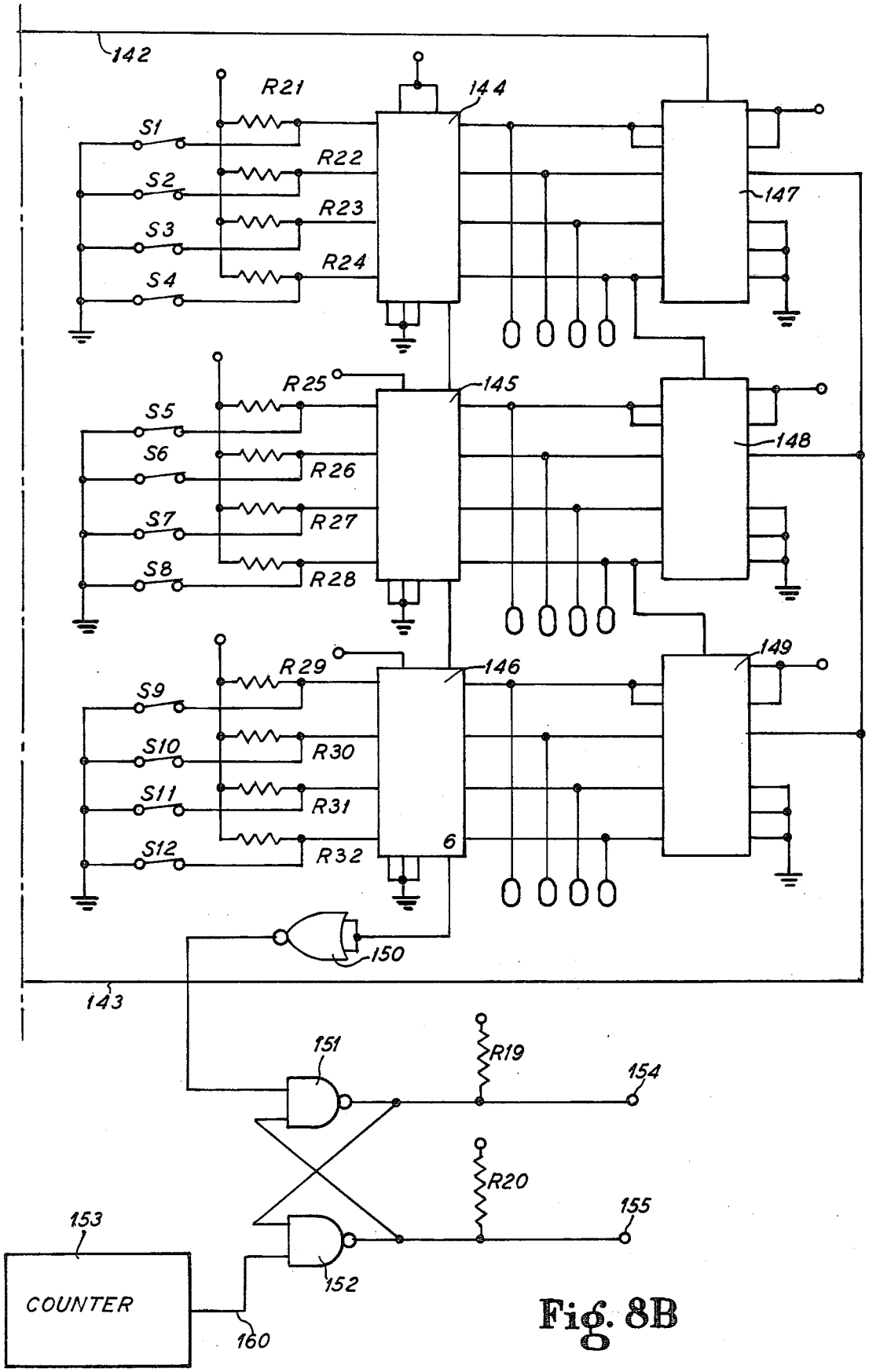

FIGS. 8A and 8B comprise schematics of a modified form of the invention and FIGS. 9A–9L illustrates wave forms appearing in the schematic of FIGS. 8A and 8B.

The lagging edge of a sheet of paper is detected by the photocell 18 which is connected to the base contact of a transistor Q1 which has its emitter connected to ground and its collector connected to a terminal of an integrated circuit 130. The resistance change in the photocell 18 causes the transistor Q1 to stop conducting to bring a terminal of integrated circuit 130 to a high level. This positive going transition will cause the output of the integrated circuit 130 on an output to produce a positive going pulse of approximately 40 microseconds length. Contacts of integrated circuit 131 are connected together and to ground and supplies an output to a terminal of integrated circuit 132. A terminal of integrated circuit 132 is connected to a terminal of integrated circuit 130 and an output will produce a negative going pulse because a terminal of integrated circuit 132 will be enabled.

The operation of the gate device 24 or a knock down device will require the use of two separate counter circuits. Since the operation of the counter circuit is similar, only one of the counter circuits will be described in detail. One of the counters will determine when the gate or knock down is to go down and the second counter will determine when the gate or knock down is to go up.

The output of integrated circuit 132 is supplied to the input of a flip-flop comprising a pair of integrated circuits 133 and 134 and the negative going pulse of integrated circuit 132 will set the flip-flop comprising the integrated circuits 133 and 134. When this flip-flop is set, it allows pulses through integrated circuit 135 to integrated circuit 137 which is a dual monostable multivibrator. The input negative going pulse to the flip-flop circuit comprising 133 and 134 allows pulses at terminals of integrated circuit 137.

Integrated circuit 137 has two outputs which will be triggered approximately 180° apart from each other. A positive going pulse will cause a terminal of integrated circuit 137 to go high for 90 microseconds duration while the negative going edge will cause a terminal to go high for another 90 microsecond pulse. Thus, two separate pulse trains substantially 180° out of phase with each other will be provided at the outputs of integrated circuit 137.

The two pulse trains from integrated circuit 137 are fed to integrated circuit 141 which is a NOR-gate with the output being supplied directly to NOR-gate 141 and the output from integrated circuit 137 being supplied through the circuits 139 and 140 for a time duration determined by the resistor setting R16 of an integrated circuit 138 which also supplies an input to circuit 139. The circuit 138 comprises a one shot which is triggered by a high to low transition of circuit 138. The output of circuit 139 will last from 55 to 110 Ms thus enabling the series of pulses to integrated circuit 140 for the same time duration.

The output of integrated circuit 141 is supplied to lead 142 which is connected to the counter illustrated in FIG. 8B. The counter will receive pulses at twice the input rate for a period determined by the operation of integrated circuit 138.

The count and comparator circuit is composed of integrated circuits 144 through 149 and the resistor packs R21 through R32 which are respectively connected to the integrated circuits 144, 145 and 146. The circuit uses the BCD form for counting and compares a predetermined count that is set by thumb wheel switches S1 through S12 which are respectively connected to terminals of integrated circuits 144, 145 and 146. The binary counter circuit is triggered from the negative edge of the pulse train appearing at a terminal of the integrated circuit 147. As the BCD output is formed integrated circuits 144, 145 and 146 will compare the output to the setting of the switches S1 through S12 and a negative going pulse will appear at a terminal of integrated circuit 150 which is connected to a terminal of integrated circuit 146 when the setting of the switches S1 through S12 compares with the incoming signal.

A flip-flop comprising integrated circuits 151 and 152 receives the output of circuit 150 and supplies an output at output terminals 154 and 155 for, respectively, controlling the gate or knock down 24 so as to activate it for its down function. When a terminal of circuit 151 receives a negative pulse from the output of circuit 150, the flip-flop will set itself causing a terminal to go positive and a terminal to go to zero. Thus, the solenoid connected to gate 24 will be activated to go down.

A second counter 153 can be exactly the same as the one illustrated in FIG. 8B is preset to a count that will reset the flip-flop comprising the circuits 151 and 152 and the counter 153 produces a negative going pulse on lead 160 which is supplied to a terminal of integrated circuit 152 of the flip-flop causing the outputs at terminals 154 and 155 to change state. This will cause the solenoid causing the gate or knock down to come up to be actuated and the down solenoid will be de-energized. The second counter 153 will be triggered from the same pulse which actuates the first counter and, thus, the second counter is preset to a higher value than the first counter so that the up and down motion of the gate is obtained.

Figures 9A, 9B, 9C, 9D, 9E, 9F, 9G, 9H, 9I, 9J, 9K, 9L:
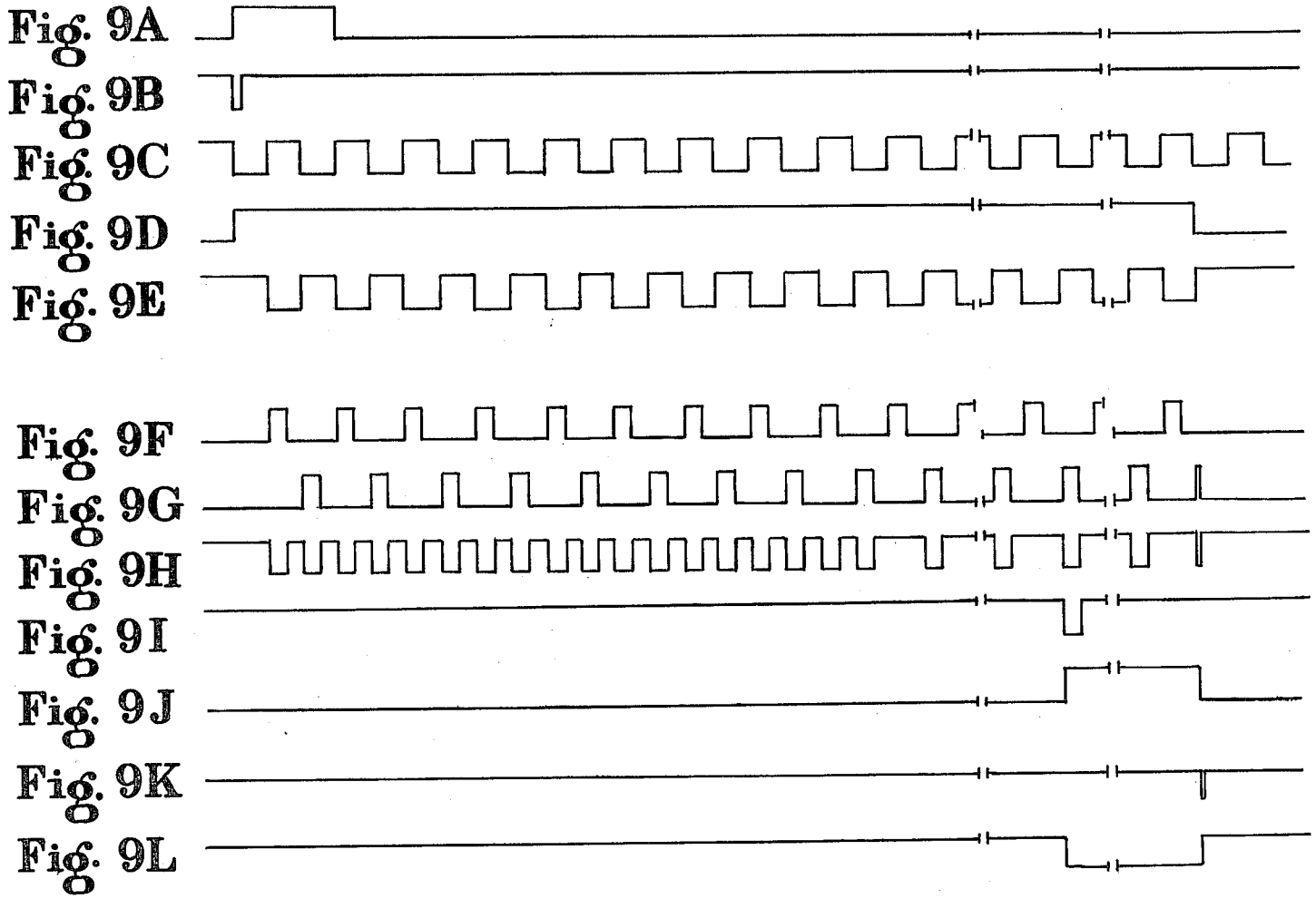
FIGS. 9A–9L are plots of wave forms existing in the schematic of FIGS. 8A and 8B.

FIGS. 9A through 9L illustrate wave forms existing in the circuit of FIGS. 8A and 8B. Wave form 9A comprises the wave form existing at terminal 161 in FIG. 8A. Wave form 9B comprises the wave form existing at circuit 132. Wave form 9C illustrates the wave form at terminal 162 in FIG. 8A. Wave form 9D illustrates the wave form at circuit 133. FIG. 9E illustrates the wave form at circuit 135. Wave form 9F is the wave form existing at integrated circuit 137. Wave form 9G is the wave form existing at integrated circuit 137. Wave form 9H is the wave form existing at integrated circuit 141. Wave form 9I is the wave form existing at circuit 150 and it goes low when the count compares with the setting of the switches S1 through S12. Wave form 9J is the wave form existing at terminal 154 which controls the gate. Wave form 9K illustrates the wave form showing when the count goes low when the input compares with the switches for the second counter.

Wave form 9L is the wave form existing at contact 155 at the output of flip-flop 151 and 152.

Integrated circuit 130 is a type SN74121N. Integrated circuits 131, 132, 151 and 152 are a type SN7400N. Transistor Q1 is a type 2N2222. Integrated circuits 133, 134, 135, 139 are a type SN7400N. Integrated circuits 141, 150 may be type SN7402N. Integrated circuit 138 may be type NE555. Integrated circuit 137 may be type SN74123N. Integrated circuits 144,145 and 146 may be type SN7485N. Integrated circuits 147, 148 and 149 may be type No. SN7490N. Resistor R12 is 15K ohms, R13 is 150 ohms. R4 is 1K, R15 is 2.7K, R16 is 100K, R17 is 2.7K, R18 is 2.7K, R19 is 2.2K, R20 is 2.2K.

It is seen that this invention provides a new and novel speed compensated timing circuit for a sheeter mechanism and although it has been described with respect to preferred embodiments it is not to be so limited as changes and modifications may be made which are within the full intended scope as defined by the appended claims.

We claim as our invention:

1. Means for actuating at the proper time a gate device which receives a plurality of moving sheets which are spaced apart, comprising means for measuring the velocity of said sheets, a sheet detector mounted so as to be energized by the spacing between said sheets, said gate device spaced a known distance from said sheet detector, a gate actuator connected to said gate means for actuating it, and control means receiving inputs from said means for measuring velocity and said sheet detector and supplying an output to said gate actuator to actuate it and wherein said control means includes a first AND gate, a first NAND gate, first and second monostable multivibrators and a timer, the output of said sheet detector connected to said first AND gate, the output of said first AND gate connected to said first multivibrator and to said first NAND gate, the output of said first NAND gate connected to said second multivibrator, a second AND gate receiving the outputs of said timer and said second multivibrator, and a first OR gate receiving the outputs of said first multivibrator and said second AND gate.

2. Means for actuating at the proper time a load device which receives a plurality of moving sheets, comprising means for measuring the velocity of said sheets which are spaced apart, a sheet detector mounted so as to be energized by the spacing between said sheets, said load device spaced a known distance from said sheet detector, a load actuator connected to said load device for actuating it, and control means receiving inputs from said means for measuring velocity and said sheet detector and supplying an output to said load actuator to actuate it and wherein said control means includes a first AND gate, a first NAND gate, first and second monostable multivibrators and a timer, the output of said sheet detector connected to said first AND gate, the output of said first AND gate connected to said first multivibrator and to said first NAND gate, the output of said first NAND gate connected to said second multivibrator, a second AND gate receiving the outputs of said timer and said second multivibrator, and a first OR gate receiving the outputs of said first multivibrator and said second AND gate.

* * * * *